US006875122B2

(12) United States Patent
Collins et al.

(10) Patent No.: US 6,875,122 B2
(45) Date of Patent: Apr. 5, 2005

(54) LASER PUTTING DEVICE

(75) Inventors: William Russell Collins, Salem, OR (US); John Darin Fiegener, Marblehead, MA (US)

(73) Assignee: tool., Inc., Marblehead, MA (US)

( * ) Notice: Subject to any disclaimer, the term of this patent is extended or adjusted under 35 U.S.C. 154(b) by 0 days.

(21) Appl. No.: 10/248,774

(22) Filed: Feb. 17, 2003

(65) Prior Publication Data

US 2004/0033842 A1 Feb. 19, 2004

Related U.S. Application Data

(60) Provisional application No. 60/358,503, filed on Feb. 19, 2002.

(51) Int. Cl.[7] ..... A63B 69/36
(52) U.S. Cl. ..... 473/220; 473/223
(58) Field of Search ..... 473/220, 223, 473/226

(56) References Cited

U.S. PATENT DOCUMENTS 5,213,331 A * 5/1993 Avanzini ..... 473/220
5,388,831 A * 2/1995 Quadri et al. ..... 473/220
5,465,972 A * 11/1995 Cornett ..... 473/220
5,611,739 A * 3/1997 Carney ..... 473/220
5,725,439 A * 3/1998 Halsey et al. ..... 473/220
5,779,555 A * 7/1998 Nomura et al. ..... 473/223
6,371,864 B1 * 4/2002 Norwood ..... 473/220

* cited by examiner

*Primary Examiner*—Gregory Vidovich
*Assistant Examiner*—Nini F. Legesse
(74) *Attorney, Agent, or Firm*—Jeffrey Furr

(57) ABSTRACT

The invention is a putter training device which comprises a laser, housing for the laser, with to connect the laser to a battery source, a battery source, and a trigger. The housing, incorporating the laser is affixed to the putter face, the wire is wound around the shaft of the putter and the battery source/trigger is affixed to the grip of the putter. The invention is designed to be removed and reattached easily and without need for frequent adjustment or calibration. Proper use of the invention simultaneously addresses three common problems for golfers: aim, effective loft, and inconsistent and off-center impact points. The device can be used indoors or out and with or without a ball. The Trigger and the laser can communicate using RF transmissions in an alternative embodiment.

8 Claims, 14 Drawing Sheets

Fiaure 11

LASER PUTTING DEVICE

CROSS REFERENCE TO RELATED APPLICATIONS

This patent claims a priority date of Provisional Pat. No. 60/358,503 dated Feb. 19, 2002.

COPYRIGHT STATEMENT

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND OF INVENTION

This invention relates to golf club alignment devices, in particular putting alignment devices incorporating one or more lasers. 1. Background Putting is an important part of the game of golf. Roughly 30% to 50% of strokes occur on or around the green for most golfers. Most professional golfers would, in fact, say that it is the most important part of the game. Their ability to make a relatively high percentage of fairly easy putts is critical to maintaining a competitive edge. Most highly skilled golfers devote a large portion of their practice hours at the putting green or indoor facilities. Less skilled golfers should probably devote more.

Putting is a very difficult skill to perfect. It is the only shot that maintains contact with the ground over its entire distance. As a consequence, there are a number of factors that influence the result of a putt. The quality of the putting surface, the amount of break or bend in the putt, the direction of the putter face at impact, the path of the putter head at impact, the location of the impact point on the putter face, the amount of relative loft at impact, and the amount of force applied are just some of the factors involved.

A lot of experimentation and analysis has been done in the field. Of all the categories above, one of the most important is that relating to the direction of the putter face at impact, "aim" in general usage. Where the putter face is aimed, at the moment of impact with the golf ball has an enormous effect upon the result of the putt. Or at least on the path the ball travels.

Most putting training aids incorporating lasers attempt to assist the golfer in correctly aiming or aligning this putter. If correctly utilized, these devices will give useful feedback to the golfer whether through a point or line of light. In theory the golfer will be able to see exactly where he is aimed and, with practice, become more adept at positioning the club properly. However, these devices are generally cumbersome to use, unduly hard to calibrate, and not necessarily very accurate. There continues to exist a significant need for a laser based putting training aid that is easy to use and gives valuable, accurate feedback.

2. Description of Prior Art Related patents and Noted patents are U.S. Pat. Nos. 5,611,739, 5,165,691, 5,169,150, 5,193,812, 5,207,429, 5,213,331, 5,330,188 and 5,388,832.

The need for a putter trainer that is very accurate, non-cumbersome and easy to calibrate shows that there is still room for improvement in the art.

SUMMARY OF INVENTION

The present invention relates to a putter trainer that is accurate, non-cumbersome and easy to calibrate.

It is the object of the present invention to provide a putter trainer that allows a user to train with accuracy. It is another object of the present invention to provide a putter trainer that is non-cumbersome to use and easy to calibrate. The invention comprises a laser, housing for the laser, with a connection of the laser to a battery source, a battery source, and a trigger. The housing, incorporating the laser is affixed to the putter face, the wire is wound around the shaft of the putter and the battery source/trigger is affixed to the grip of the putter. The invention is designed to be removed and reattached easily and without need for frequent adjustment or calibration. Proper use of the invention simultaneously addresses three common problems for golfers: aim, effective loft, and inconsistent and off-center impact points. The device can be used indoors or out and with or without a ball.

BRIEF DESCRIPTION OF DRAWINGS

Without restricting the full scope of this invention, the preferred form of this invention is illustrated in the following drawings.

DETAILED DESCRIPTION

Figure 1:
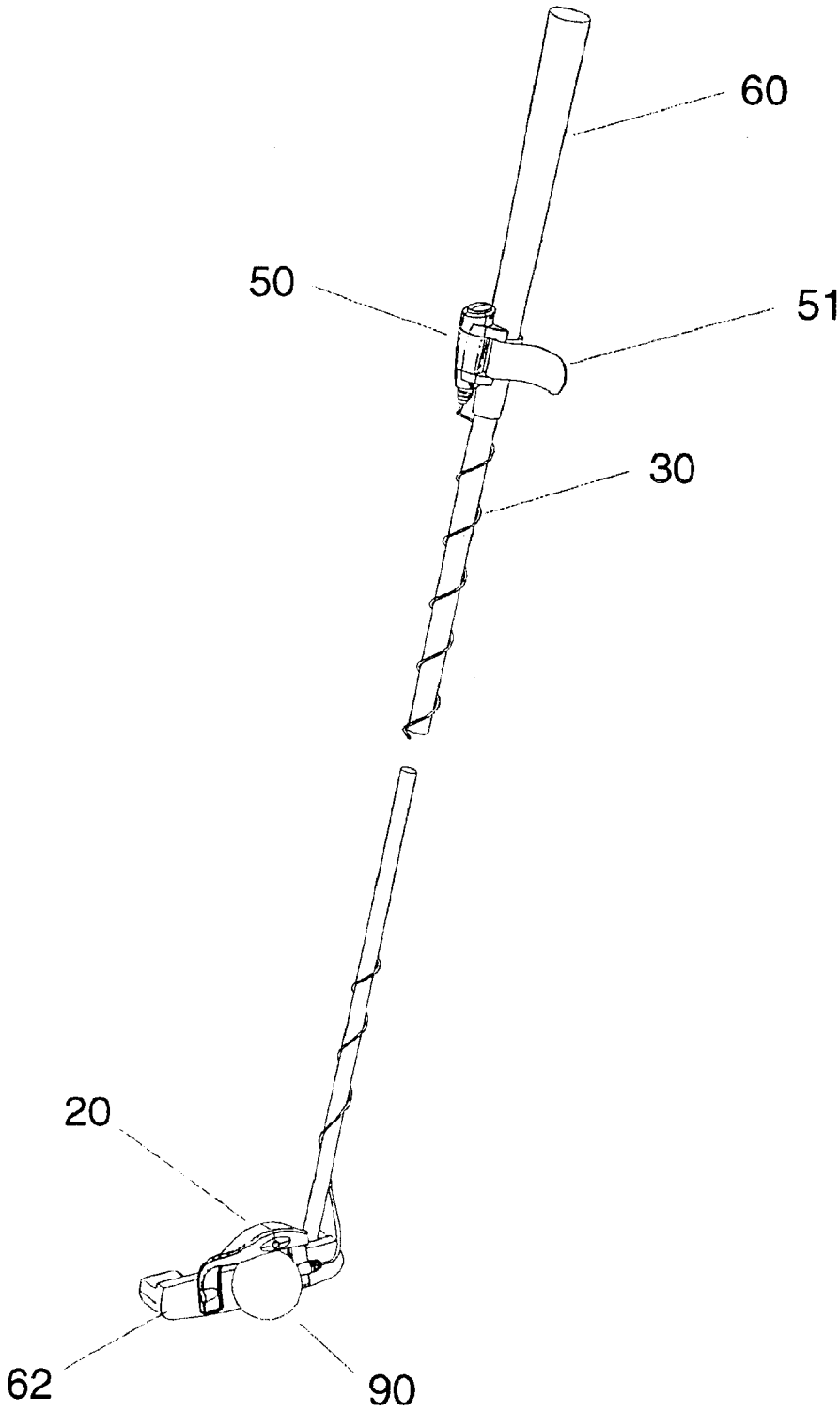
FIG. 1 shows the device on a putter.

The following description of a putter trainer is demonstrative in nature and is not intended to limit the scope of the invention or its application of uses.

There are a number of significant design features and improvements incorporated within the invention.

As shown in FIG. 1 and FIGS. 2–13, the putting guidance device 1 is composed of two main members connected via a wire 30. The two units are described as a base unit 20 and a switch unit 50. It should be noted here that a key concept of this design is that the design can be used with all styles of putters 60.

The switch unit 50 gets attached to the putter grip 67 portion of a conventional putter 60. The switch base 57 part of the switch 50 has two molded in slots 58 opposite each other for allowing a Velcro band 51 to secure the switch 50 to the grip portion 67 of the putter 60. The switch unit 50 runs parallel with the putter shaft 60 with the switch 70 on the switch unit 50 facing the top of the grip of the putter 60. As stated, the switch portion is connected through a connection means 51, such as Velcro, around the grip of the putter shaft 60 and the cable or wire 30 is then coiled down the shaft to where the base unit 20 is attached. The base unit 20 is attached to the face 62 of the putter 60. The unit does not require the user to use a special putter to practice with the device 1. The base unit 20 gets attached by an attaching means 8 such as reusable tape to the face or ball striking side of the putter head 62. The base unit 20 62 has features such as pins 6 molded in that allow the user to easily attach and align the unit on to the face 62.

Figure 2:
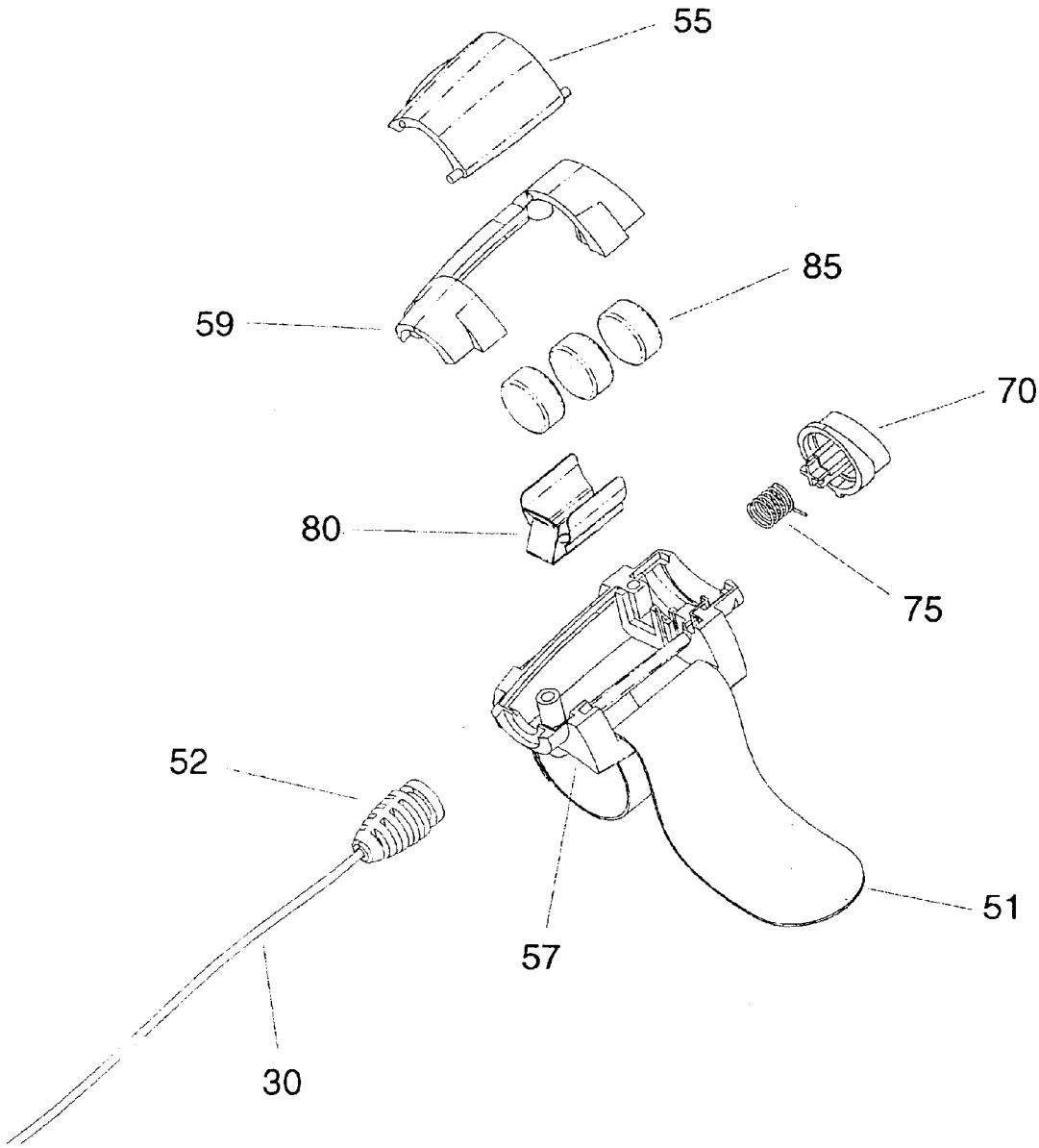
FIG. 2 shows the components of the switch unit.
Figure 3:
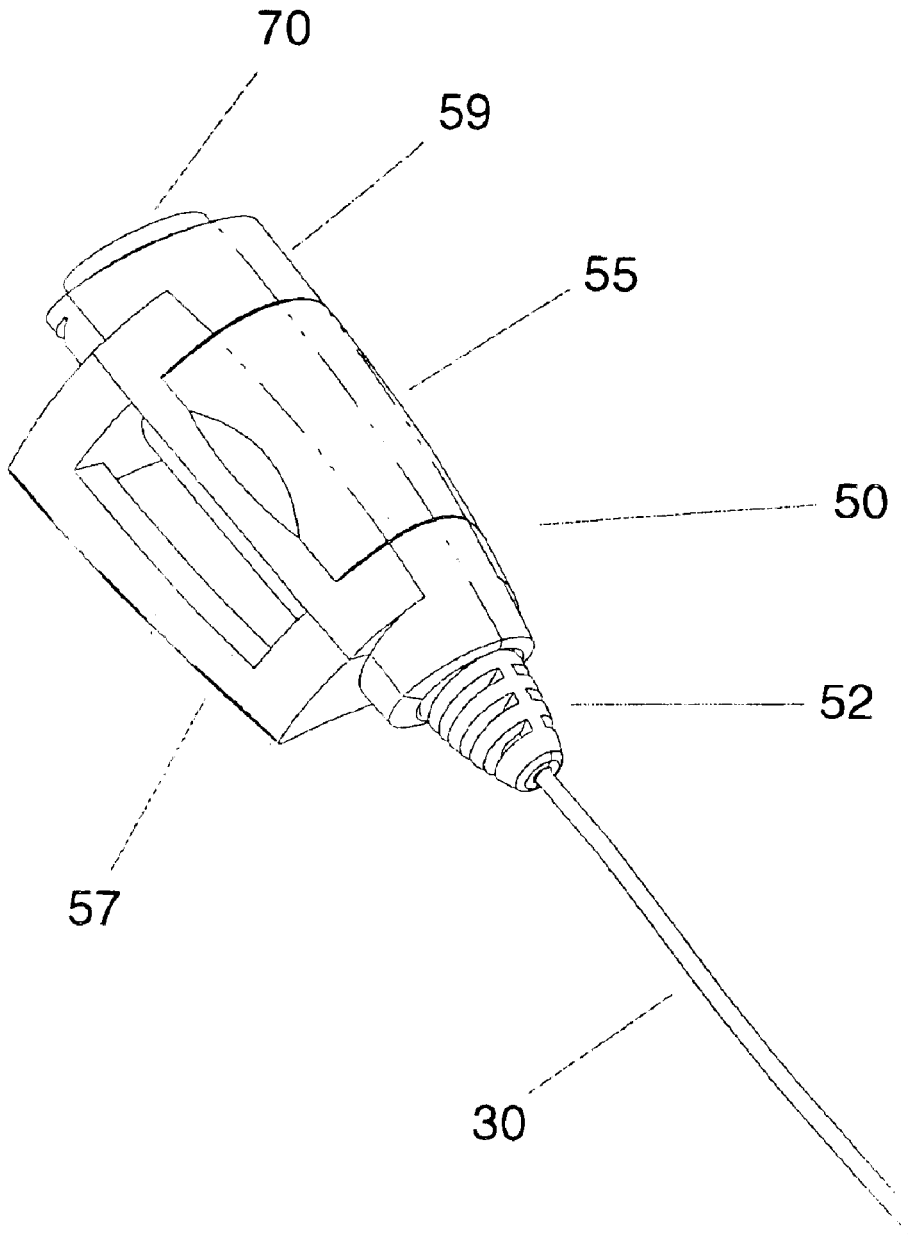
FIG. 3 shows the switch unit.
Figure 4:
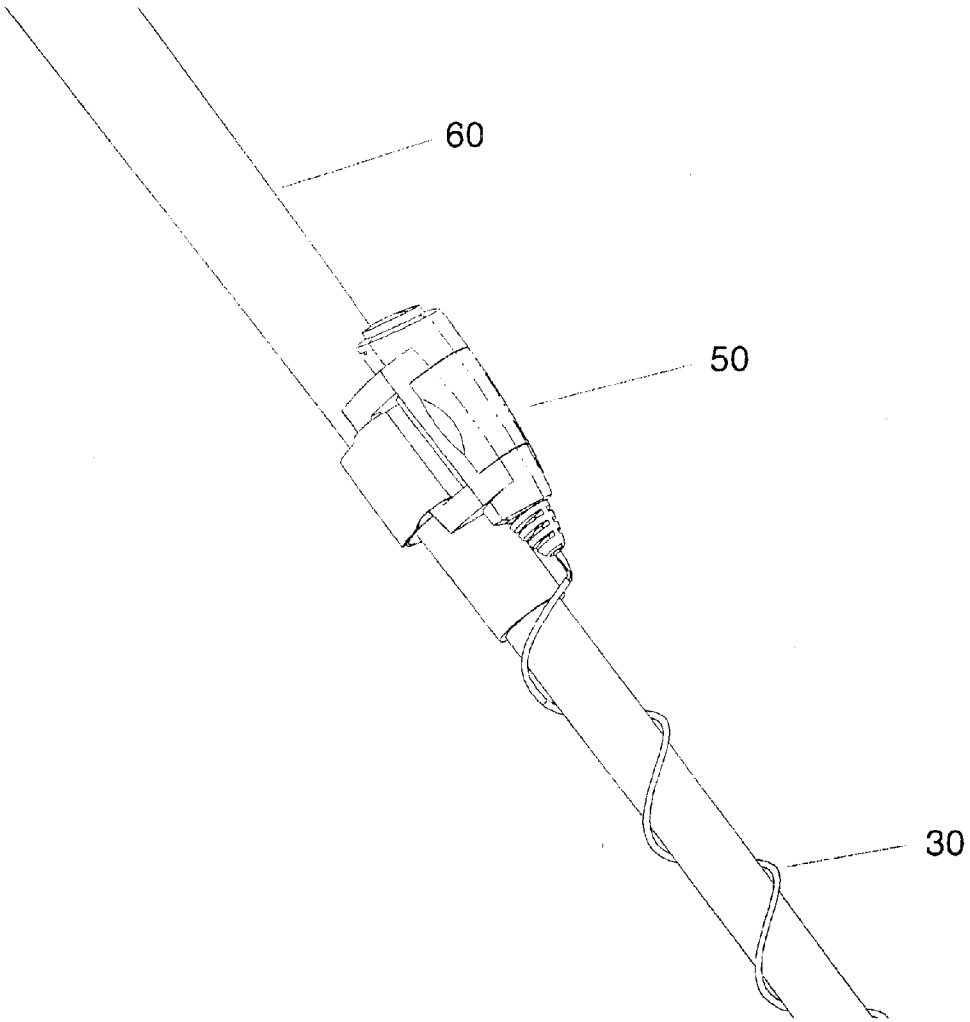
FIG. 4 shows the switch unit on a putter.
Figure 5:
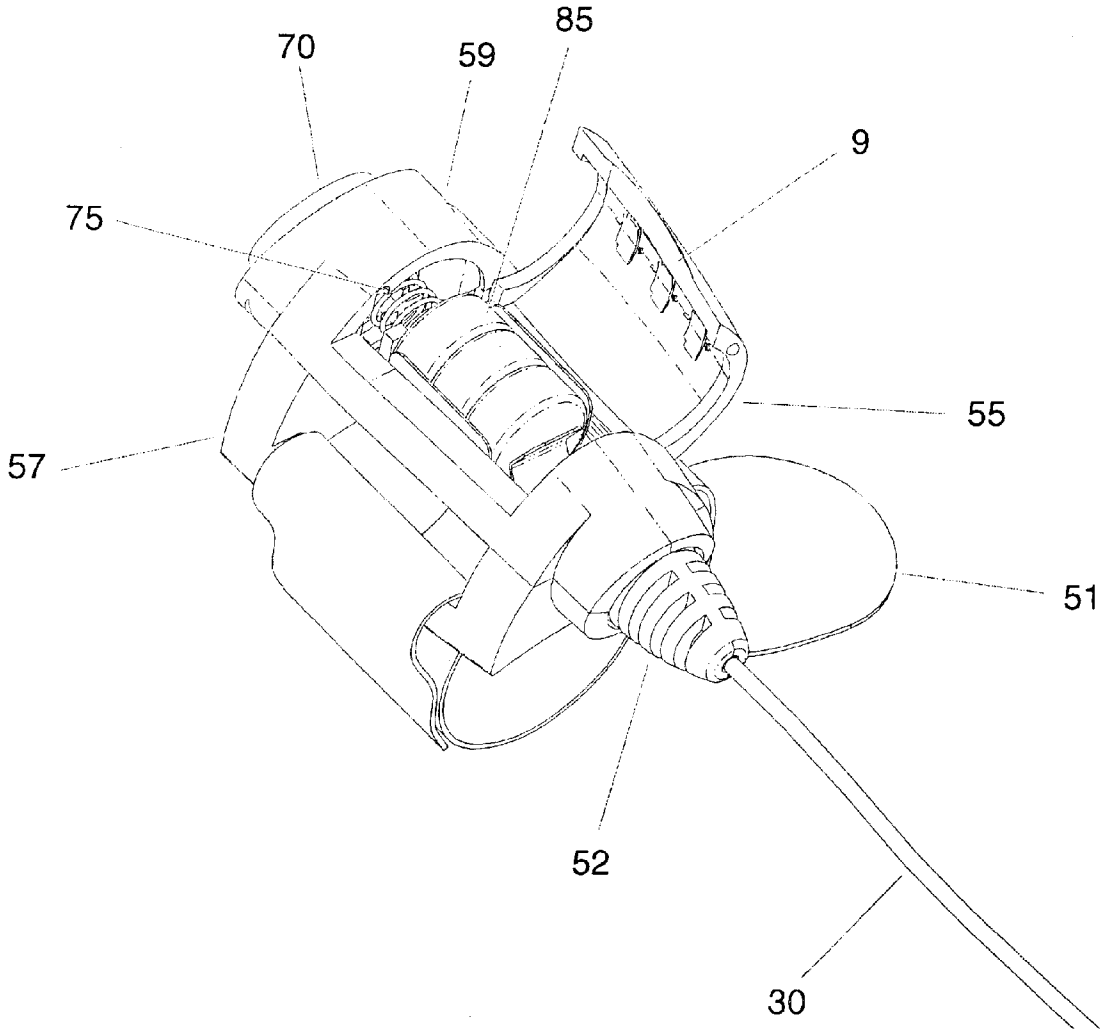
FIG. 5 show the swith unit with the door open.
Figure 6:
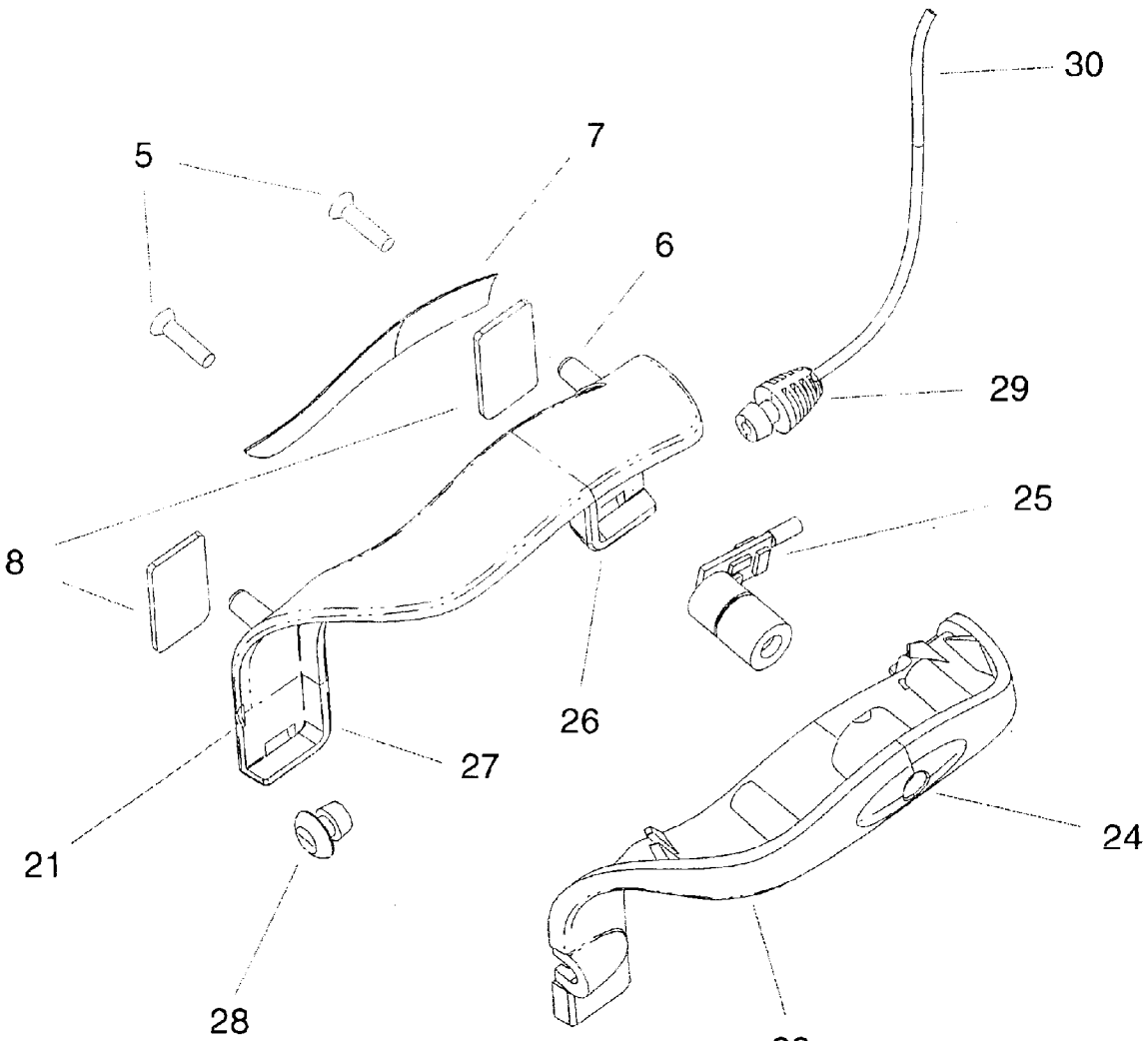
FIG. 6 shows the components of the base unit.
Figure 7:
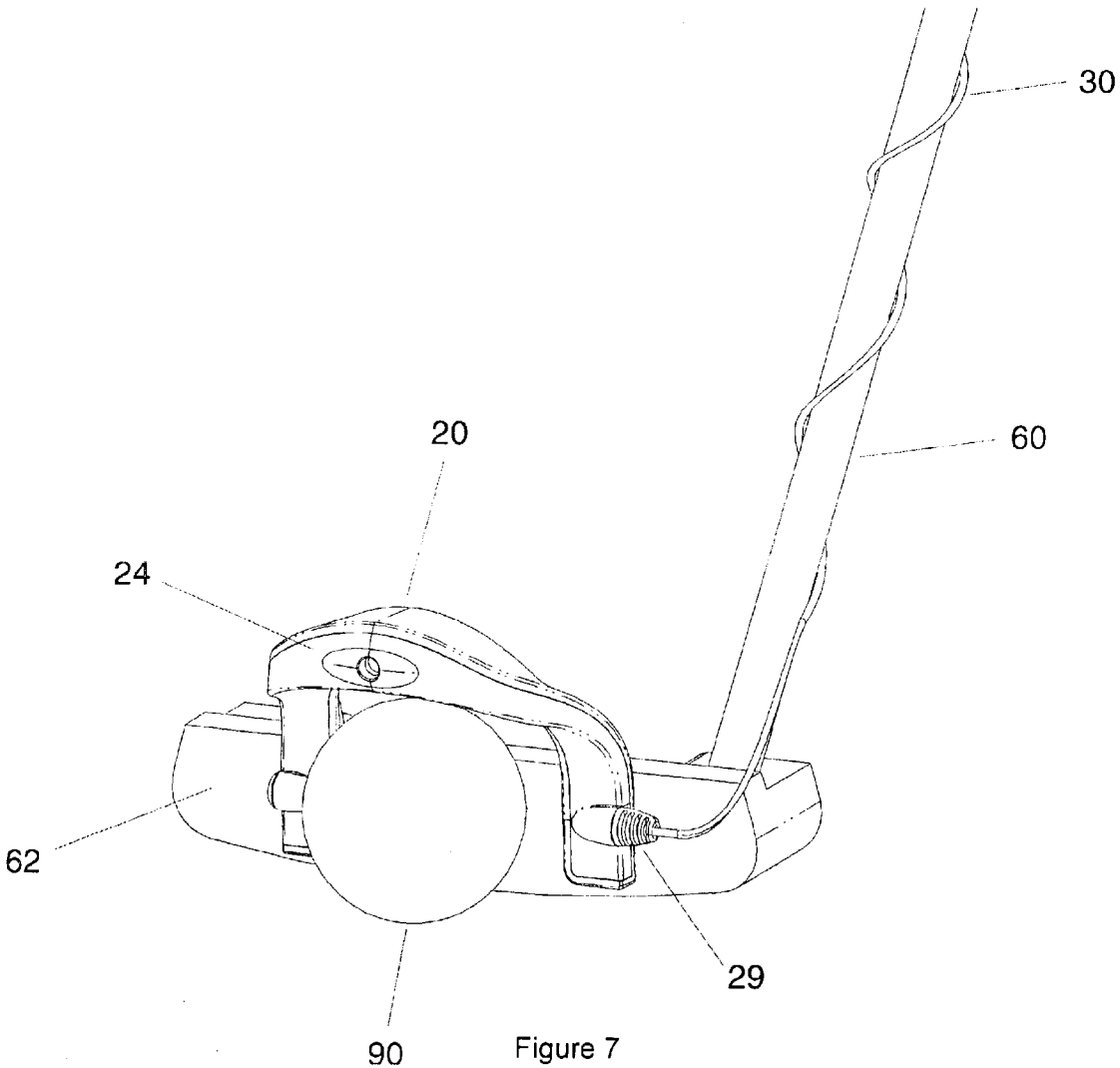
FIG. 7 shows a side front view of the base unit on a putter head.
Figure 8:
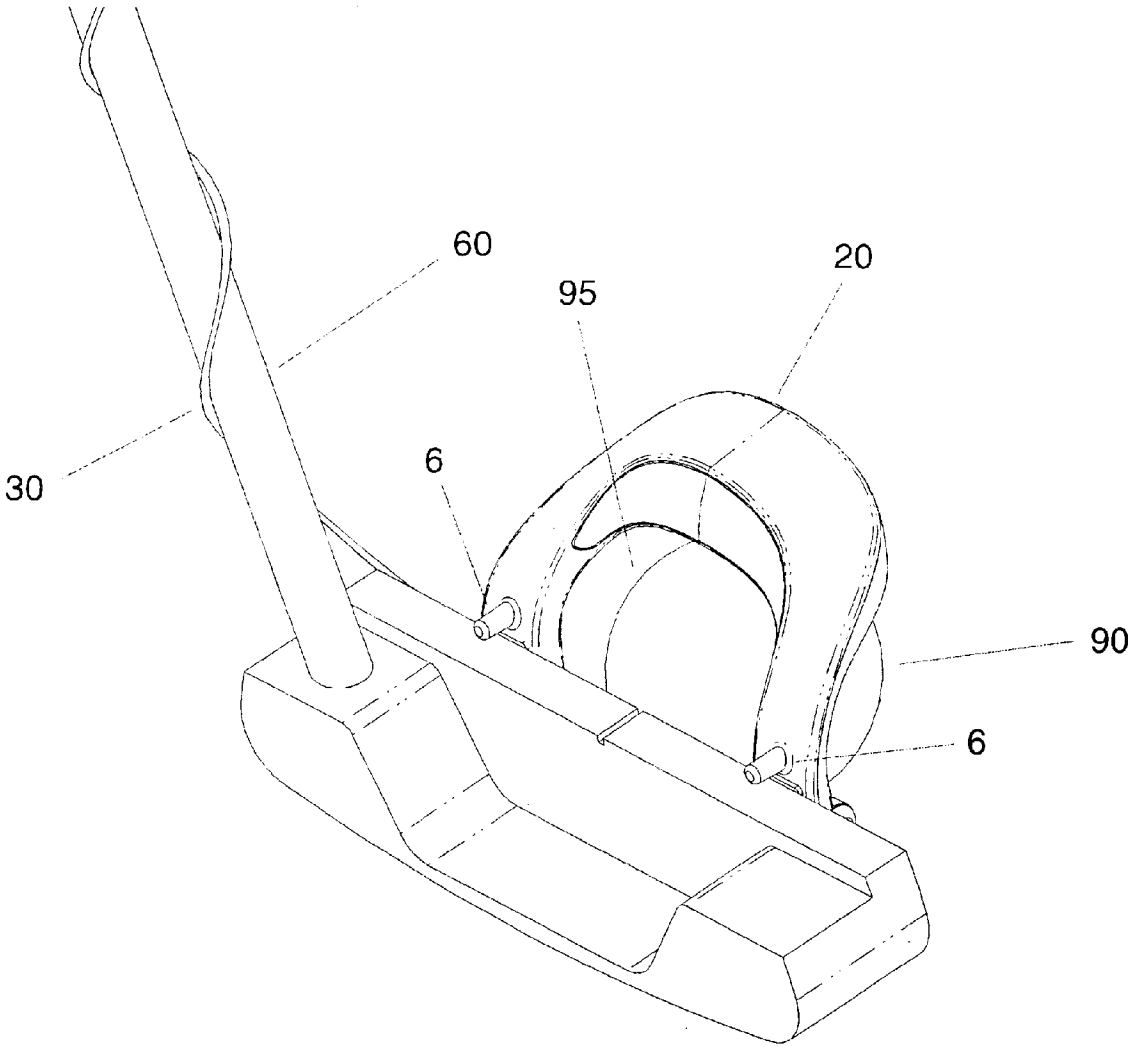
FIG. 8 shows a side back view of the base unit on a putter head.

As shown in FIG. 2, the switch assembly 50 consists of seven fixed components and batteries 85. The switch consists of a molded base 57, top 59 and battery door 55. The top of the switch assembly 50 has an elastomeric switch button 70. The end where the wire 30 exits the housing 50 is contained in an elastomeric strain relief 52. The battery door 55 is captured between the top 59 and base 57 pieces and allows access to the power source which in the preferred embodiment is batteries 85 held inside the switch assembly 50. The batteries 85 are contained inside the plastic housing via a metal battery holder 80 and electrical contact carrier 85. The battery carrier 85 is heat stacked to the base piece 57. The top 59 and base piece 57 in the preferred embodiment are connect by a connecting means such as screws 5 which is screwed together capturing the battery door 55, elastomeric switch 70 and wire strain relief 52. The base piece 57 is an injection-molded part that has two opposing slots for an attaching means 51 which in the preferred embodiment is a Velcro strap. The Velcro strap 51 is woven through the base part for attaching the complete assembly 50 to the putter 60. The batteries 85 are changed by the user through the battery door 55. The battery door 55 has a hinging means about an axis that runs parallel with switch assemble 50. The battery door 55 has a molded in detent 9 that snaps the door 55 shut. The door 55 must be deflected to bypass the snap and open the door 55.

At the base of the elastomeric switch 70 there is a small metal contact 75 that is glued to the base of the elastomeric switch 70. The metal contact 75 serves the purpose contacting the top of the battery stack 85, therefore closing the circuit and engaging the laser 10. The current flows out of the switch assemble 50 via the wire 30. The wire 30 comes out of the switch assembly 50 through the strain relief 52.

In the preferred embodiment, the base 57, top 59 and door 55 are made through an injection molding process using a strong but light weight material such as a hard plastic. The elastomeric switch and the elastomeric strain relief are molded.

In the preferred embodiment, the elastomeric switch 70 on the switch unit 50 activates the laser projection unit 25 only when depressed. This gives feedback only when desired. The golfer can position the club 60 so as to aim at a target and, upon depressing the switch 70, learn how accurate his aim is.

In the preferred embodiment, the elastomeric switch 70 is very sensitive. This, combined with the ability to position the switch unit 50 anywhere on the grip mean that the laser projection means 25 can be activated with very light pressure and very small finger movements. The less force required, the less putter head 62 movement and the more accurate the feedback.

As shown in FIG. 6 and FIGS. 7–13, the base unit 20 is composed of seven parts. The base unit 20 uses a clamshell design to capture all components inside the base housing 23. The main pieces are called the base bottom 21 and base top 22. In the preferred embodiment, both the base bottom 21 and top 22 are injection-molded parts made of a durable light weight plastic. When combined the top 22 and bottom 21 become a contained housing 23 that resembles a piece of twisted ribbon in the form of an upside down "U". This forms two base unit legs, left 26 and right 27. The apex or tangent of the "U" is where a laser projector such as a laser diode 25 is located. In the preferred embodiment, the laser projector is a laser diode 25 which is an OEM assembly that consists of the laser diode and a small PC board. The laser diode board is 90 degrees to the axis of the beam. The diode is housed in a tubular portion 24 of the base bottom piece and is then captured by the top when screwed down. The wires from the diode PC board runs down one of the two legs of the "U" assembly to a stain relief 59 that is captured between the top 22 and bottom 21 main housing parts of the base unit 20. The laser diode 25 can be positioned on either leg to allow for both left and right hand assemblies. The side that does not take the strain relief and wire 30 is filled with a second elastomeric part in the base assembly 23. The clamshell assembly is contained with the use of two screws S. In the preferred embodiment, a Standard class IIIa laser warning sticker 7 conceals the screw heads.

The base 20 has a connecting means to connect it to the putter face 62, in the preferred embodiment this is a small piece of double-sided tape 8 on each of the legs that is used to adhere the unit to the face of the putter 60. The tape 8 has a permanent side and a removable side. As an alternative, the base unit 20 could be attached to the putter face 62 through the use of Velcro. The Velcro would be placed on the putter face 62 and the Velcro mates would be on the legs 26 and 27. The user would then remove the part by detaching the Velcro. The removable side allows the user to remove and reuse the tape as often as desired. As shown in FIGS. 6–13, the shape of the base unit 20 when attached to the putter face is that of an upside down "U", as stated, with the tangent of the "U" jetting away from the putter face. This jetting out reveals an open area between the base legs 26 and 27. This is called the "ball viewing port" 95. The ball viewing port 95 allows the user to see the ball 90 on or next to the putter face 62 and when the ball 90 is impacted by the putter 60. The base unit 20 accommodates for 3 to 4 degrees of putter face 62 loft.

Figure 9:
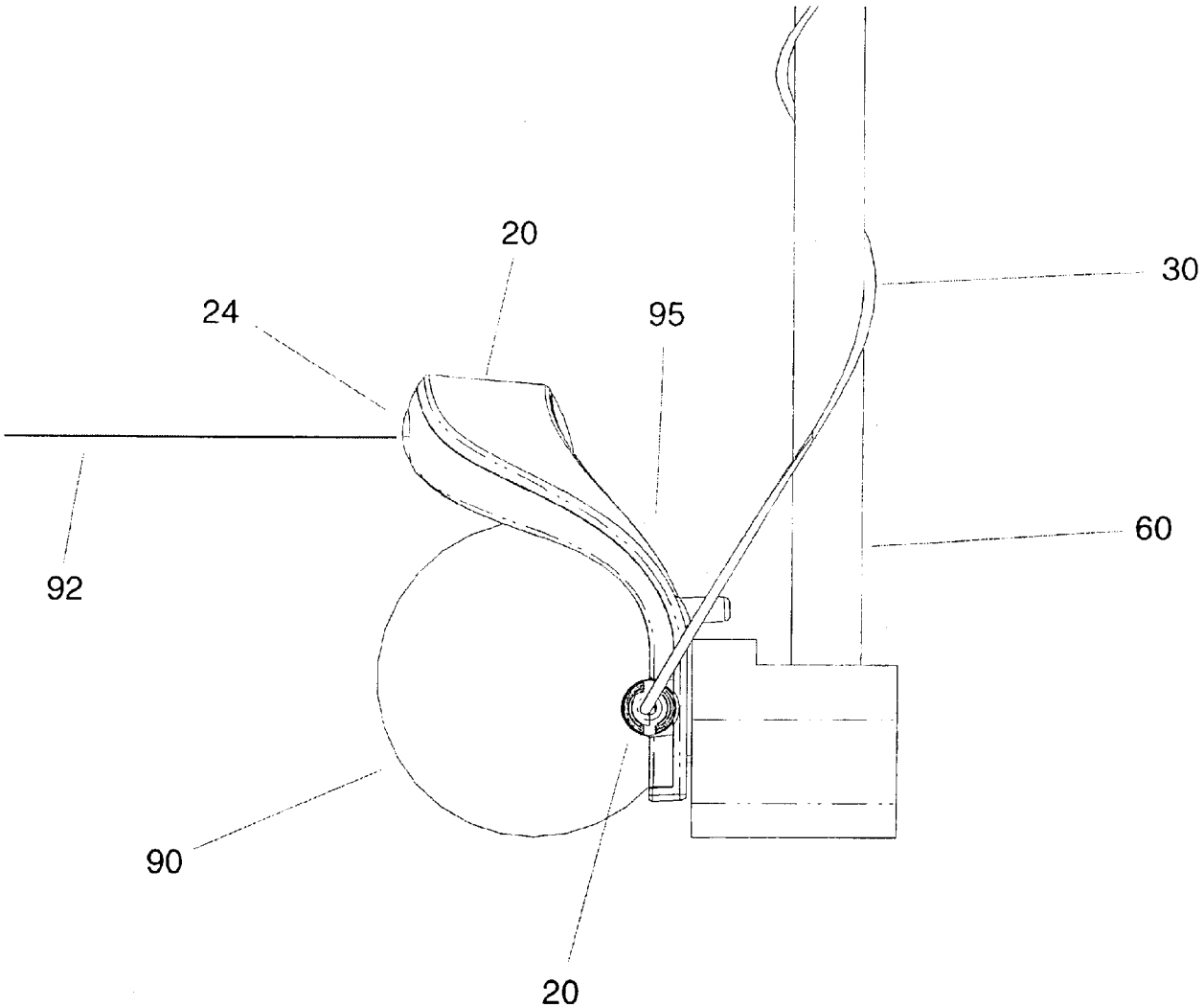
FIG. 9 shows a side view of the base unit on a putter head.
Figure 10:
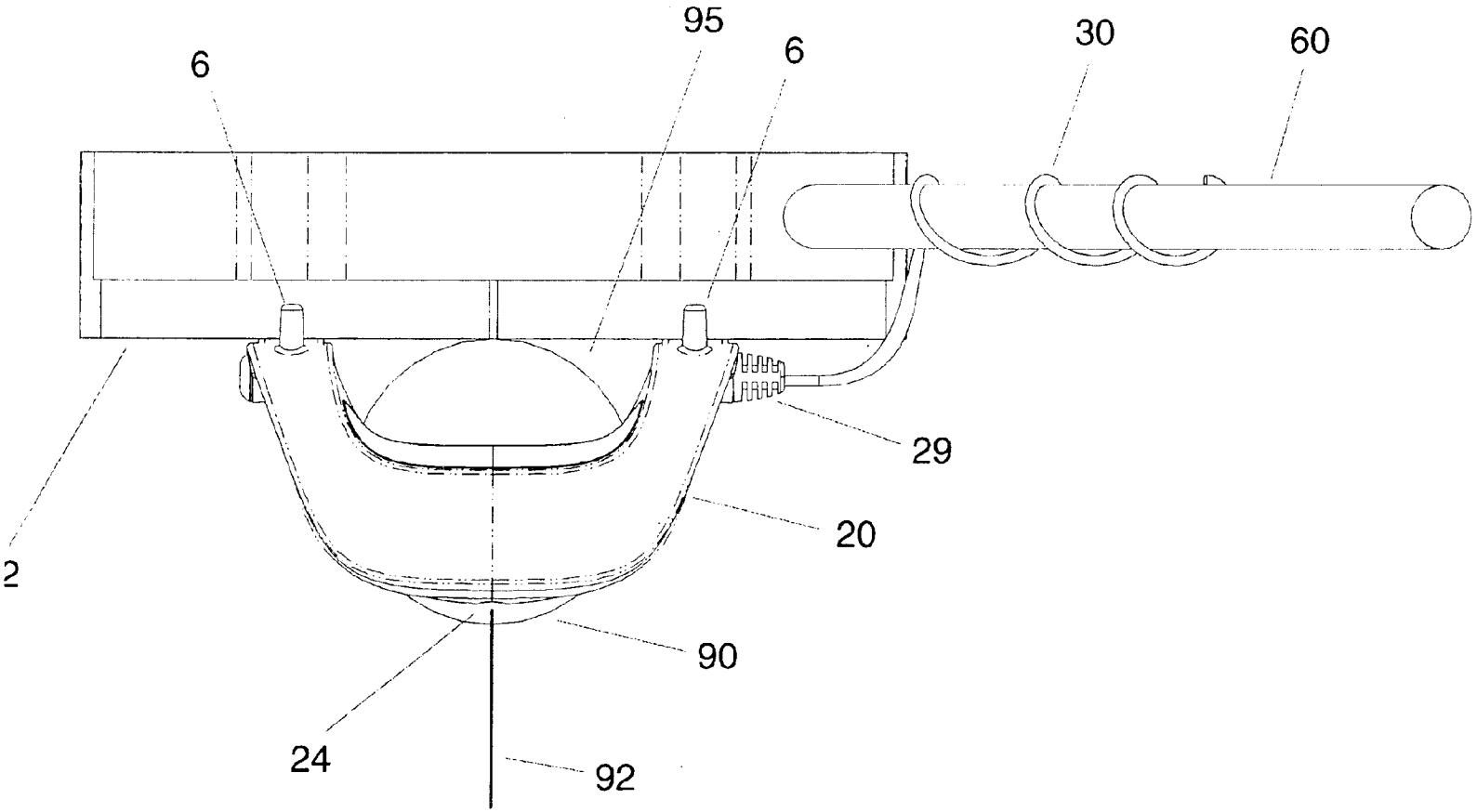
FIG. 10 shows a top view of the base unit on a putter head.
Figure 11:
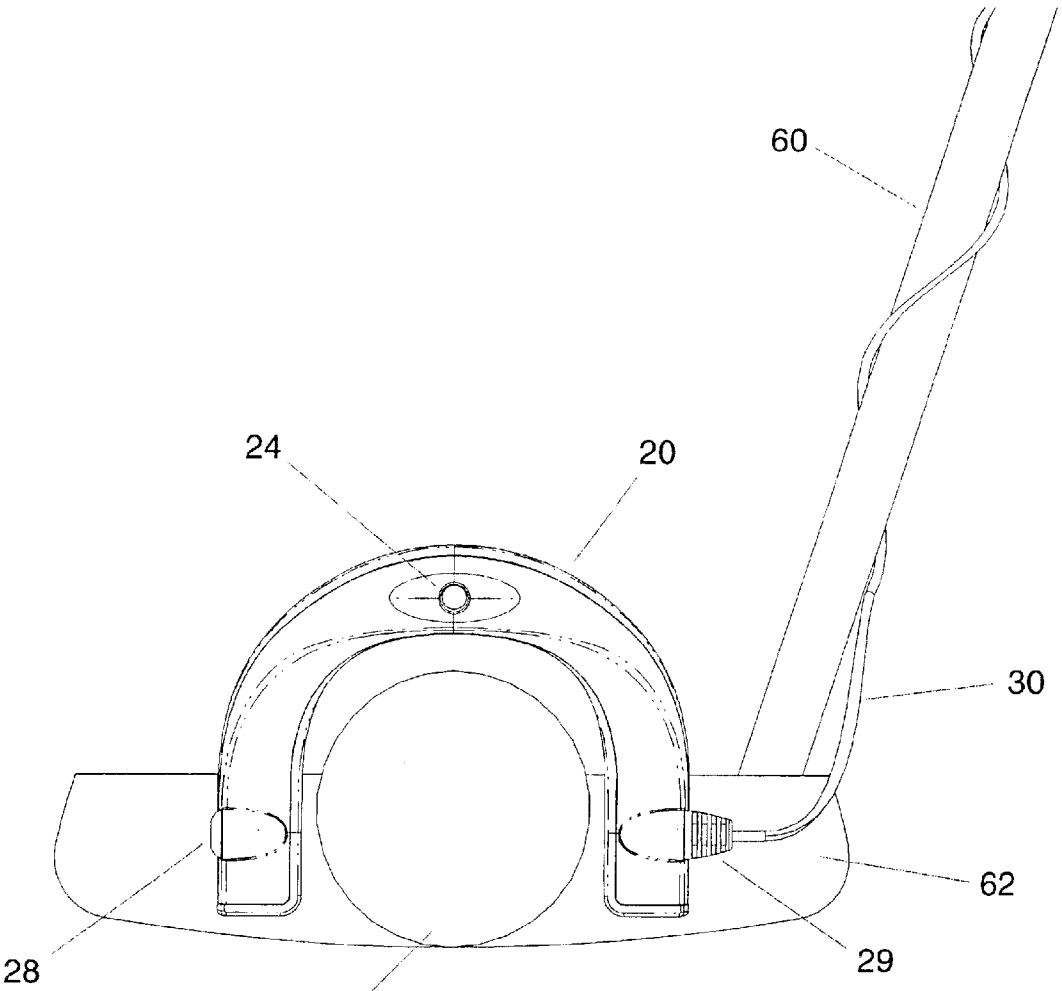
FIG. 11 shows a front view of the base unit on a putter head.
Figure 12:
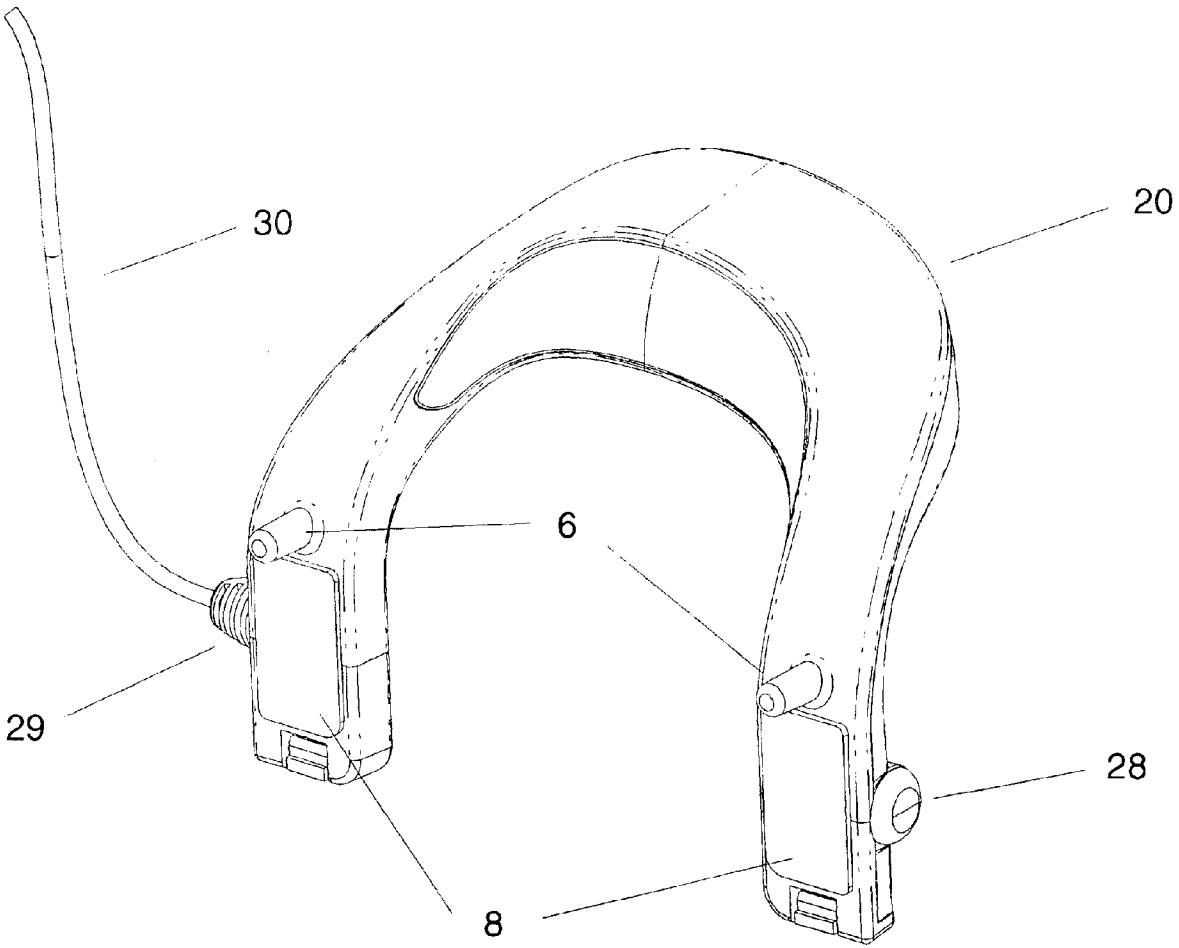
FIG. 12 shows a side back view of the base unit.
Figure 13:
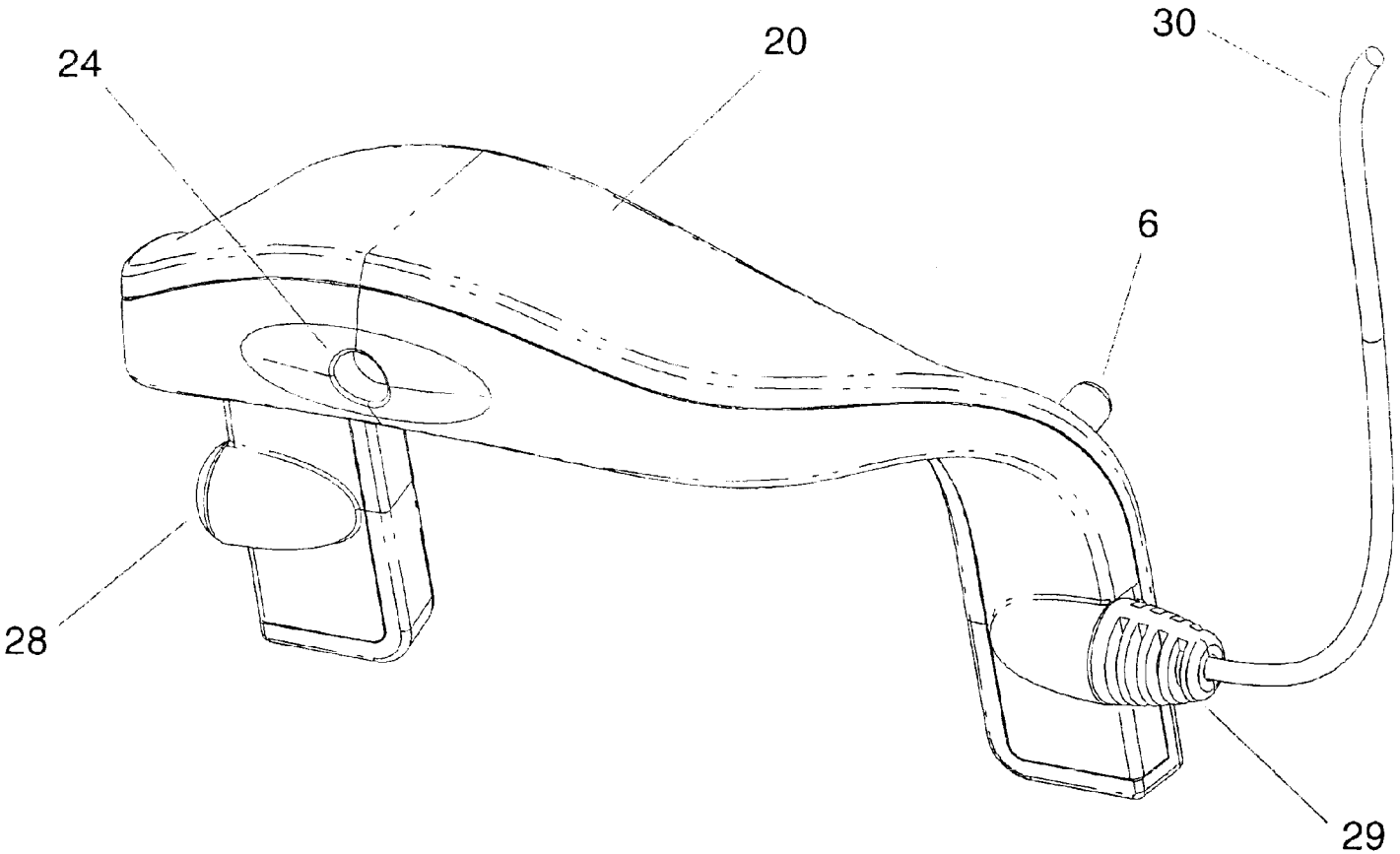
FIG. 13 shows a side front view of the base unit.

As detailed in FIGS. 9 and 10, the housing 20, when properly affixed to the putter face 62, is designed so as to offset the loft on the putter face 62 and project a light beam 92 parallel to the ground 100 and perpendicular to the putter face 62. Most putters 60 are manufactured to incorporate a small amount of loft in the design, 3 degree address is most common. The loft is intended to help the ball get up on top of the grass surface and rolling quickly and smoothly. In the preferred embodiment uses an offset of 3 degrees of loft but may well be introduced in other lofts offsets, as consumer demand requires. By neutralizing the effect of this loft the golfer is able to aim at low-height targets even over considerable distances.

The projection of a beam of light 92 from a "properly" soled club 60 allows the golfer to measure the effective loft of his clubface at address. Many, but by no means all, golfers use a "forward press" to reduce the angle of the forward wrist. This device 1 allows golfers to see the effect of their forward press on the relative angle of the putter face 62. Too much forward press and the ball 90 will tend to bounce before rolling. The point of laser light 92 traveling only a short distance before striking the ground indicates this. Too much loft and the ball 90 will jump. A point of light 92 well above parallel indicates this. Both instances increase the variability of the result and are to be avoided. As a consequence, due to its design gives the golfer valuable insight into the position of his hands and wrists and the relative loft of the putter face 62 at address. Players can then adjust to a more desired position through practice.

The legs 26 and 27 of the base unit 20 will incorporate a series of markings, lines, dots, tabs or pegs in order to make accurate attachment to the putter face simple. These markings may cut into and or project slightly back from the legs 26 and 27. To the extent that the base unit 20 must be twisted slightly on the putter face 62 to achieve maximum accuracy, the markings, lines, dots or tabs will also assist the golfer in reattaching the device consistently at later date.

As stated above, the "arch" joins the legs. The arch incorporates the laser at or near its apex. The arch is curved when viewed from above and projects outward, away from the clubface when properly affixed to the putter. This curvature is very important as it creates the ball viewing port 95 through which some of the ball may be viewed, even as the invention is used. By allowing the golfer to see the majority of the ball 90, particularly that portion of the ball 90 nearest the putter face 62, it helps the mind of the golfer to ignore the base unit 20, keeping his perception of the putter head 62 as unchanged as possible.

The design of the base unit 20 keeps the entire housing unit 23 in front (in the direction of the target) of the putter face 62. This is important. This allows the golfer to practice with the invention without altering his perception of the putter 60. The housing 23 obscures no lines, angles or other visual cues provided by the putter head 62. The golfer's perception of the putter head 62 is critical in determining aim. A golfer presented with a variety of differently shaped putters 60 will often aim them differently due solely to the changing visual cues. Even while using this device 1, the golfer still retains completely clear access to the visual features of his putter head 62.

In the preferred embodiment, the color of the base unit 20 is neutral, leading the golfer's eye to ignore the base unit 20 and stay focused upon the ball 90 and the putter head 62. Again this helps minimize any perceptual impact from using the device 1.

As covered above, the shape of the base unit 20 when viewed from above is curved. When attempting to aim a putter 60, golfers use lines on the putter 60, the flat surface of the face, and other angles in order to calculate a "square" position with the face of the putter at 90 degrees to the desired taget line. The curved shape of the base unit 20 when viewed from above provides no assistance here. Again, the eye of the golfer will be forced to look somewhere other than the base unit 20 for visual cues in aiming.

The laser diode 25 projects a very narrow beam of light 92. The indication of aim is represented, in the embodiment as a point of light on the surface of the target. One of the main thought processes shared by good putters is the mental narrowing of the aim to focus on a single spot, blade of grass, or edge of the cup. The iterative learning process involved here promotes this kind of concentration. The feedback is such that it becomes more meaningful the smaller the target chosen.

In the preferred embodiment, the base unit 20 is made of a very lightweight material such as plastic. This allows the golfer to maintain a nearly consistent feel between a putter with the housing attached and one with it removed. The putting aid device 1 has the distribution of weight between the base unit 20, the wiring 30 and the switch assembly 30 reduces the impact on the "swing weight" of the putter 60. The putter 60 may be slightly lighter with the putting aid device 1 removed but it will feel much the same in the hands of the golfer.

The legs 27 and 28 of the base unit 20 are spaced wide enough to allow putts to be hit near the center of the putter face 62. The legs 27 and 28 will noticeably affect any putts hit too far away from the center of the putter face 62. This will provide valuable feedback to golfers with an erratic pattern of impact points. It is well documented that good putters tend to hit putts consistently in the center of the putter face 62. Use of this aid will help poor putters become more consistent in this regard.

Alternative Embodiment

Figure 14:
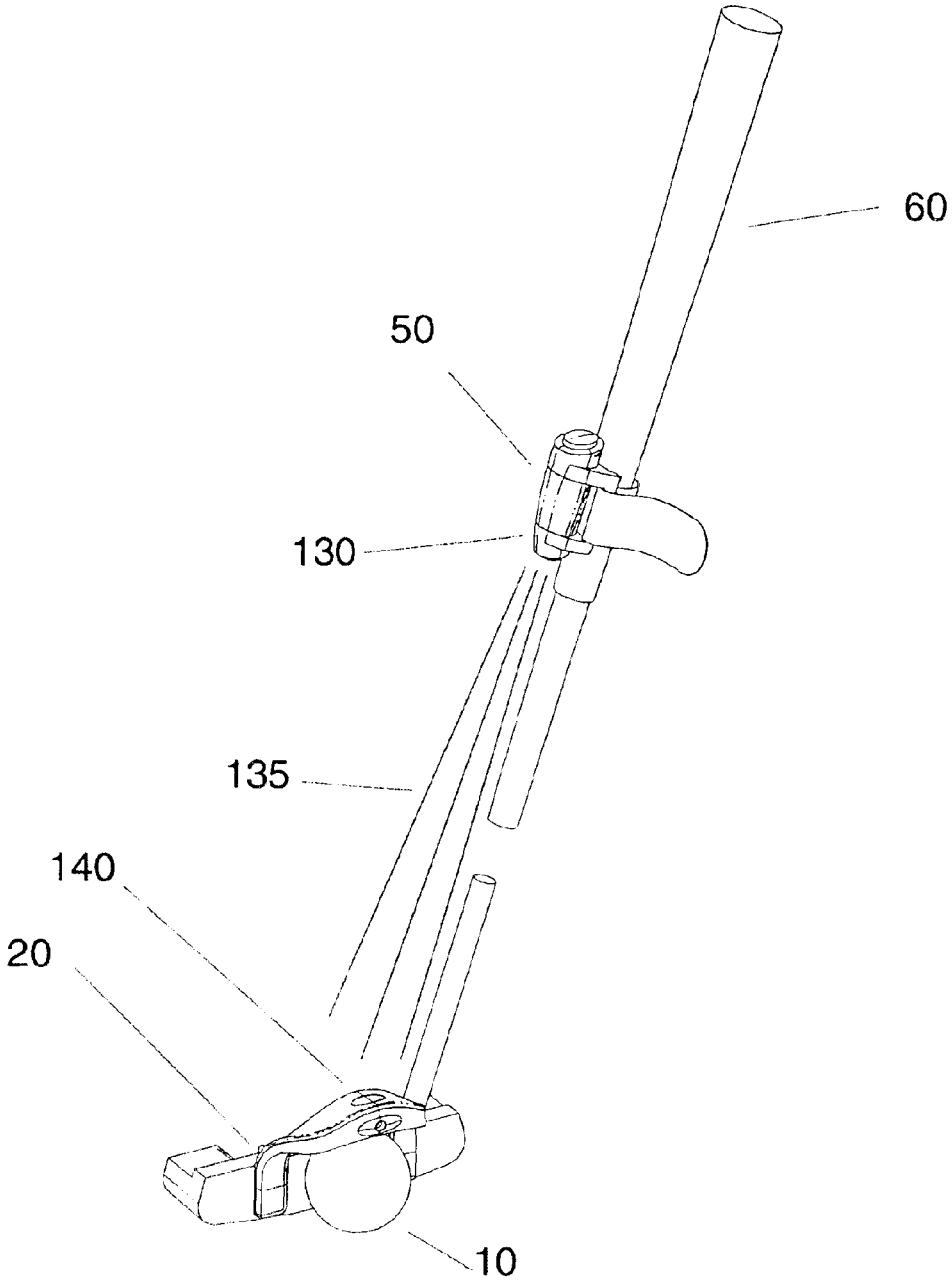
FIG. 14 shows the base unit and switch unit using wireless communication.

An alternative embodiment of the putting guidance device 1 is to have the trigger assembly 50 and the base unit 20 connected through a wireless means without the use of a wire 30. As shown in FIG. 14, this is done by having an RF (Radio Frequency) transmitter 130 in the trigger assembly. The base unit 20 would have an RF receiver 140 within the base unit. The elastomeric switch 70 would be triggered sending a signal to the RF transmitter 130 which would transmit a signal 135 to the RF receiver 140 in the base unit 20. The base unit would also have its own power source such as batteries 185.

Operation Once the putting guidance device 1 is attached to the putter 60 the user can now practice putting and then switching on the laser projection means 25 by the elastomeric switch 70 to see how accurate the putt would be. The putting guidance device 1 also allows the user to take the putt if desired.

The switch assembly 30 can be placed anywhere on the grip 67 with the use of a connecting means 51 such as a Velcro cinch or similar attachment mechanism. It is important that the golfer be able to position the trigger assembly 50 just below the bottom of his fingers as he takes his normal grip on the putter 60.

The projection of a beam of light 92 parallel from the ground 100 and perpendicular to the club face 62 from a "properly" soled club 60 allows the golfer to measure the effective loft of his clubface at address. Many, but by no means all, golfers use a "forward press" to reduce the angle of the forward press on the relative angle of the putter face. Too much loft and the ball will jump. A point of light well above parallel indicates this. This increases the variability of the result and is to be avoided. As a consequence, due to its design gives the golfer valuable insight into the position of his hands and wrists and the relative loft of the putter face at address. Users can then adjust to a more desired position through practice.

The invention can be used with any putter 60 with a sufficiently flat ball-striking face. This describes the vast majority of putters 60 on the market. In particular the position of the shaft in the putter head 62 has no impact on the efficiency of the invention.

It can be used with either right or left-handed putters 60. The base housing 23 can be opened and the wiring 30 switched to the opposite side.

Advantages

The previously described version of the present invention has many advantages, including many elements missing in all prior art.

The putting guidance device 1 is intended to be used by novice to somewhat advanced golfers who are interested in improving their aim when putting. It allows the user to line up a putt, see the ball at the face of the putter and then switch on the laser to see how accurate the putt would be. This feedback allows the golfer to gain an understanding about how much deviation is in their current stroke and where to correct it. The putting guidance device 1 gives instant feedback as to where the golfer is actually aiming. A key feature about the putting guidance device 1 is the ability to use the device with the putter 60 that will be used in play. Once a golfer uses the putting guidance device 1 he/she can make small adjustments on the green based on feedback from the device. As stated before the ball viewing port allows the user to see the ball next to the putter face and when the ball is impacted by the putter.

Aspects of putting improved by this design: As variously discussed above, there are many aspects of putting that are positively reinforced through using this aid. To be very clear these are:

1. Aiming of the putter face. The user knows immediately whether he has aimed left or right of his target.

2. Effective loft of the putter at set up. The user will get immediate information on how much forward press is involved in his set up. It may well be that, in order to achieve a better roll on his putts, the user uses the aid to either increase or decrease that press.

3. Hitting the putt in the center of the putter face. If the putter face impacts the ball too far away from the center of the putter face the legs of the housing will send the ball away on a path that indicates a miss-hit.

4. Achieving a narrow focus of aim. To be useful this aid has to be aimed at very specific targets. As the user gets better at the aiming process, the targets used will naturally decrease in size. This promotes the same sort of very specific targeting that is so useful on the course.

5. Understanding the effects of head movement. One of the big problems many putters have is moving their head and or shoulders during the stroke. Typically this is done in order to see the result. Unfortunately this "looking" often results in head and shoulder movement during the stroke, even if the intent is to look after the stroke. Use of this aid allows the golfer to see the effect of moving his head. Unless that movement is very small and or slow (better yet if it is just the eyes), the point of light on the target will tend to shift. This awareness is critical if the golfer is to avoid this fault of "looking" too early.

6. Improved stroke. The ability to hit the ball while the aid is on the putter is very useful. If the golfer verifiably knows that, at the time of initiating the putting stroke, he is aimed directly at his chosen target, any miss must be a result of some other factor. Further, if practice is done on a level and smooth surface (no break) the miss is almost certainly a result of a stroke or impact flaw. Further practice combined with the desire to "get the ball in the hole" will naturally result in a stroke that gets the ball to roll at least initially towards whatever target is chosen.

7. The legs of the housing are attached to the putter face using double sided tape, magnets, glue, of some other type of adhesive that can be readily removed from and then reattached to the putter face.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed.

Therefore, the point and scope of the appended claims should not be limited to the description of the preferred versions contained herein.

What is claimed is:

1. A putting training device comprising: a base unit; a switch unit; and a laser projector, where said base unit has two legs which form an upside down U shape where said laser projector is located at top center between the two legs, where said base Unit is connected to said switch unit through a connection that runs through one of said legs.

2. A putting training device as in claim 1 where said base unit and switch unit are connected by an RF means.

3. A putting training device as in claim 1 where said laser projector is a laser diode.

4. A putting training device as in claim 1 where said switch unit has a trigger.

5. A putting training device as in claim 1 where said base has a viewing port through which the ball can be seen.

6. A putting training device as in claim 1 where said laser projector projects a beam of light perpendicular from the putter face, which the base unit is attached to, at a target.

7. A putting training device as in claim 1 where said base unit has a loft adjustment.

8. A Putting training device as in claim 1 where said switch unit has a power Source.

* * * * *